US010333254B2

(12) United States Patent
Zhao

(10) Patent No.: US 10,333,254 B2
(45) Date of Patent: Jun. 25, 2019

(54) ELECTRICAL CONNECTOR WITH SHIELDING PLATE AND SHELL SOLDERED TOGETHER

(71) Applicant: FOXCONN INTERCONNECT TECHNOLOGY LIMITED, Grand Cayman (KY)

(72) Inventor: Jun Zhao, Huaian (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/847,883

(22) Filed: Dec. 19, 2017

(65) Prior Publication Data

US 2018/0175557 A1 Jun. 21, 2018

(30) Foreign Application Priority Data

Dec. 19, 2016 (CN) ..... 2016 1 1175273

(51) Int. Cl.

| | |
|---|---|
| ***H01R 12/72*** | (2011.01) |
| ***H01R 24/60*** | (2011.01) |
| ***H01R 13/506*** | (2006.01) |
| ***H01R 13/6581*** | (2011.01) |
| ***H01R 13/6585*** | (2011.01) |
| ***H01R 13/6594*** | (2011.01) |
| ***H01R 13/6595*** | (2011.01) |

(52) U.S. Cl.

CPC ..... *H01R 13/6585* (2013.01); *H01R 13/506* (2013.01); *H01R 13/6581* (2013.01); *H01R 13/6594* (2013.01); *H01R 13/6595* (2013.01); *H01R 24/60* (2013.01); *H01R 12/725* (2013.01)

(58) Field of Classification Search

CPC ..... H01R 13/6581; H01R 13/6585; H01R 13/6593–6595

See application file for complete search history.

(56) References Cited

U.S. PATENT DOCUMENTS

| | | | | |
|---|---|---|---|---|
| 9,379,494 | B1 * | 6/2016 | Hu | H01R 13/6594 |
| 9,735,511 | B2 | 8/2017 | Kao et al. | |
| 9,912,111 | B2 * | 3/2018 | Little | H01R 24/60 |
| 2015/0194770 | A1 * | 7/2015 | Little | H01R 13/6582 439/607.27 |
| 2016/0294102 | A1 * | 10/2016 | Zhao | H01R 13/6581 |
| 2017/0077654 | A1 * | 3/2017 | Yao | H01R 13/6594 |

(Continued)

FOREIGN PATENT DOCUMENTS

| | | |
|---|---|---|
| CN | 203983631 U | 12/2014 |
| CN | 104993287 B | 8/2017 |

*Primary Examiner* — Edwin A. Leon
*Assistant Examiner* — Oscar C Jimenez
(74) *Attorney, Agent, or Firm* — Wei Te Chung; Ming Chieh Chang

(57) ABSTRACT

An electrical connector includes a contact module enclosed within a metallic shielding shell. The contact module includes an insulative housing and a plurality of upper contacts and lower contact with a metallic shielding plate commonly retained in the housing. The upper contacts and the lower contacts have the corresponding contacting sections and soldering sections exposed upon the mounting surface of the housing. The shielding plate has the contacting area on the mounting surface. The shielding shell forms contacting legs positioned upon the contacting area for grounding.

14 Claims, 7 Drawing Sheets

(56) References Cited

U.S. PATENT DOCUMENTS

| | | | | |
|---|---|---|---|---|
| 2017/0085040 | A1* | 3/2017 | Tsai | H01R 13/6596 |
| 2017/0271822 | A1* | 9/2017 | Zhang | H01R 12/7082 |
| 2017/0288326 | A1* | 10/2017 | Wang | H01R 12/775 |
| 2017/0288360 | A1* | 10/2017 | Zhao | H01R 13/5219 |
| 2017/0302037 | A1* | 10/2017 | Yao | H01R 13/6595 |
| 2017/0324187 | A1* | 11/2017 | Zhu | H01R 13/5202 |
| 2017/0338586 | A1* | 11/2017 | Wang | H01R 13/5219 |
| 2017/0346232 | A1* | 11/2017 | Zhao | H01R 24/60 |
| 2017/0373441 | A1* | 12/2017 | Zhao | H01R 12/58 |
| 2018/0151983 | A1* | 5/2018 | Zhao | H01R 13/504 |
| 2018/0151987 | A1* | 5/2018 | Zhao | H01R 13/506 |
| 2018/0151988 | A1* | 5/2018 | Zhao | H01R 13/6595 |
| 2018/0175559 | A1* | 6/2018 | Zhao | H01R 13/6591 |

* cited by examiner

ELECTRICAL CONNECTOR WITH SHIELDING PLATE AND SHELL SOLDERED TOGETHER

FIELD OF THE DISCLOSURE

The invention is related to an electrical connector, and particularly to the connector with the shielding plate and the metallic shell soldered together.

DESCRIPTION OF RELATED ARTS

China Patent No. 204216260 discloses the electrical connector having a contact module enclosed within a metallic main shell. A metallic shielding plate contacts the inner surface of the metallic shell via the tiny legs, thus resulting in unstable grounding effect.

It is desired to provide a connector with a reliable grounding effect.

SUMMARY OF THE DISCLOSURE

To achieve the above desire, an electrical connector includes a contact module enclosed within a metallic shielding shell. The contact module includes an insulative housing and a plurality of upper contacts and lower contact with a metallic shielding plate commonly retained in the housing. The upper contacts and the lower contacts have the corresponding contacting sections and soldering sections exposed upon the mounting surface of the housing. The shielding plate has the contacting area on the mounting surface. The shielding shell forms contacting legs positioned upon the contacting area for grounding.

DETAILED DESCRIPTION OF THE PREFERRED EMBODIMENT

Figure 1:
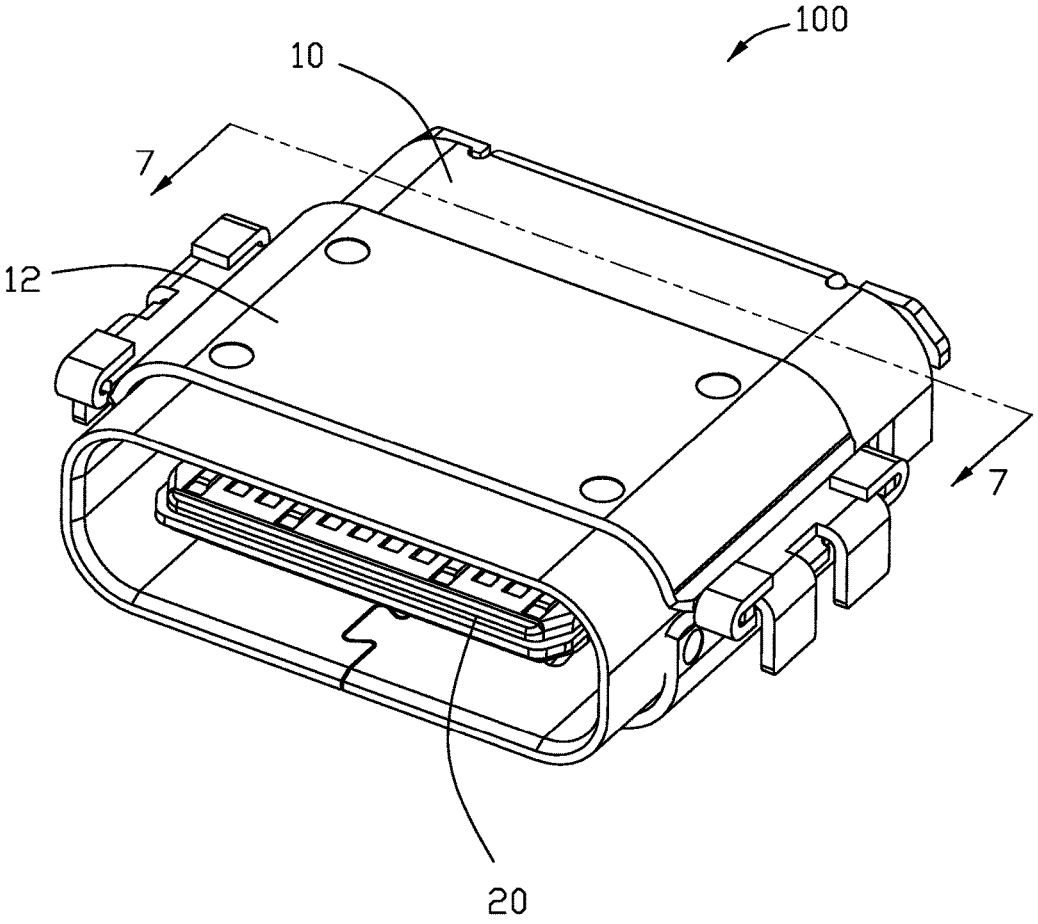
FIG. 1 is a perspective view of the electrical connector of the invention.
Figure 2:
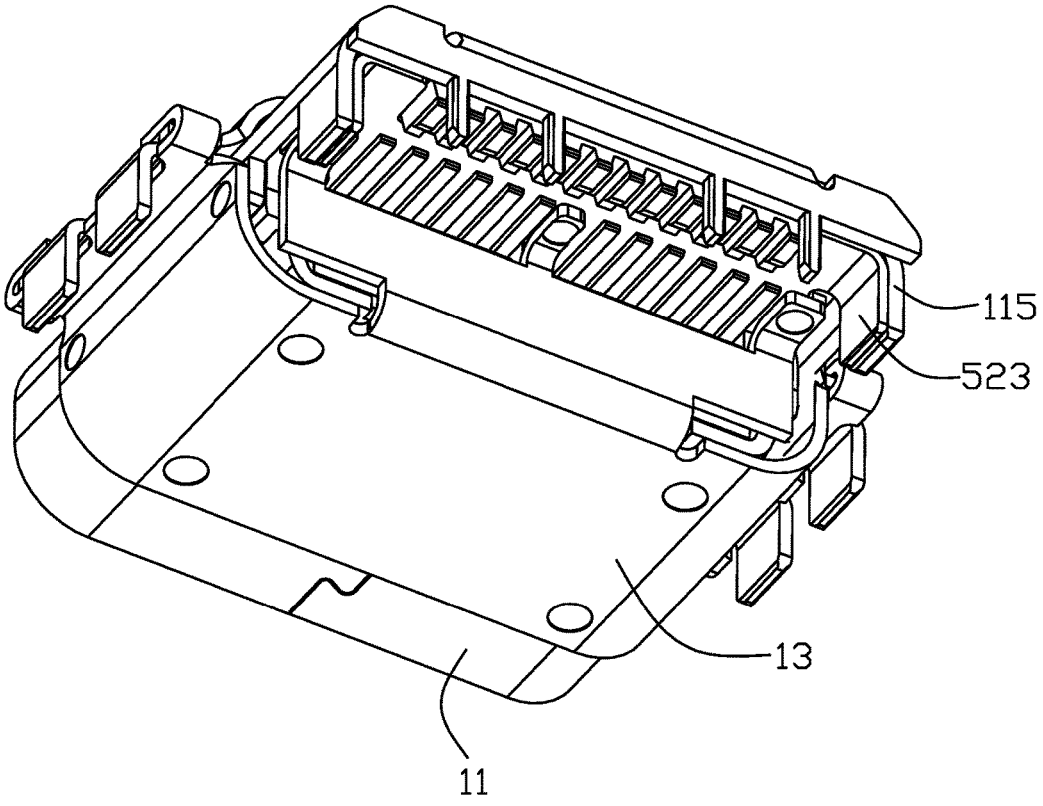
FIG. 2 is another perspective view of the electrical connector of FIG. 1.
Figure 3:
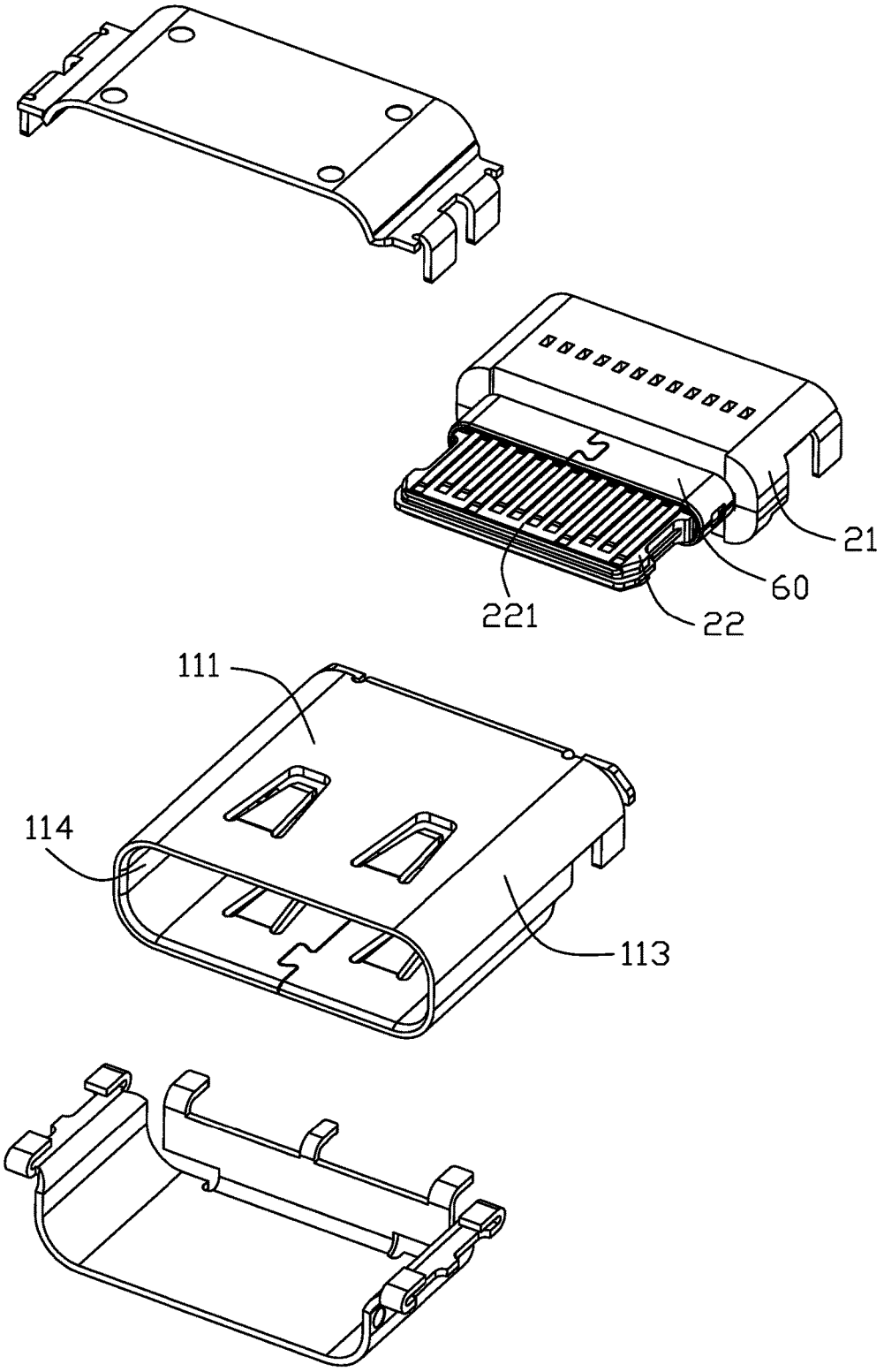
FIG. 3 is an exploded perspective view of the electrical connector of FIG. 2.
Figure 4:
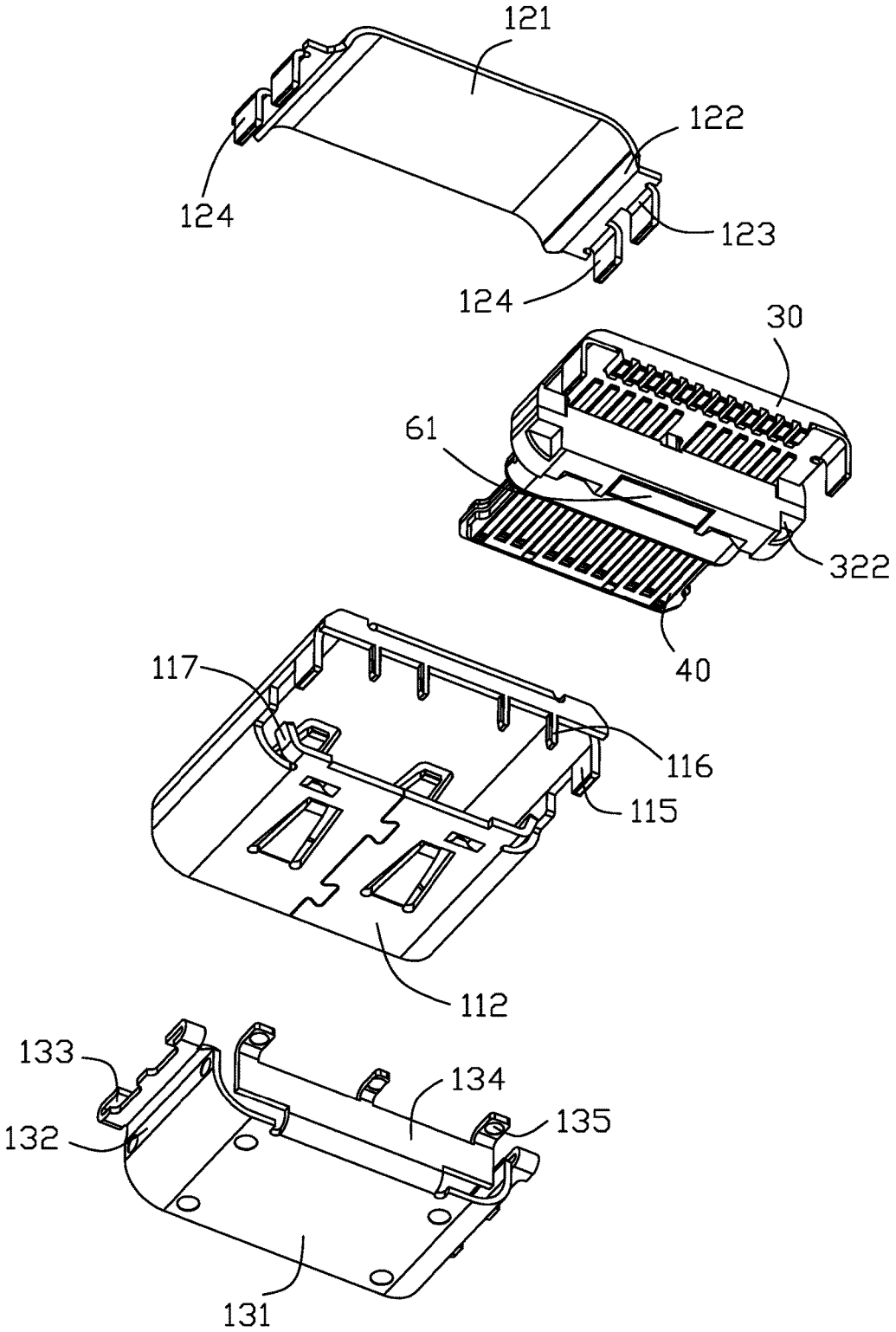
FIG. 4 is another exploded perspective view of the electrical connector of FIG. 3.
Figure 5:
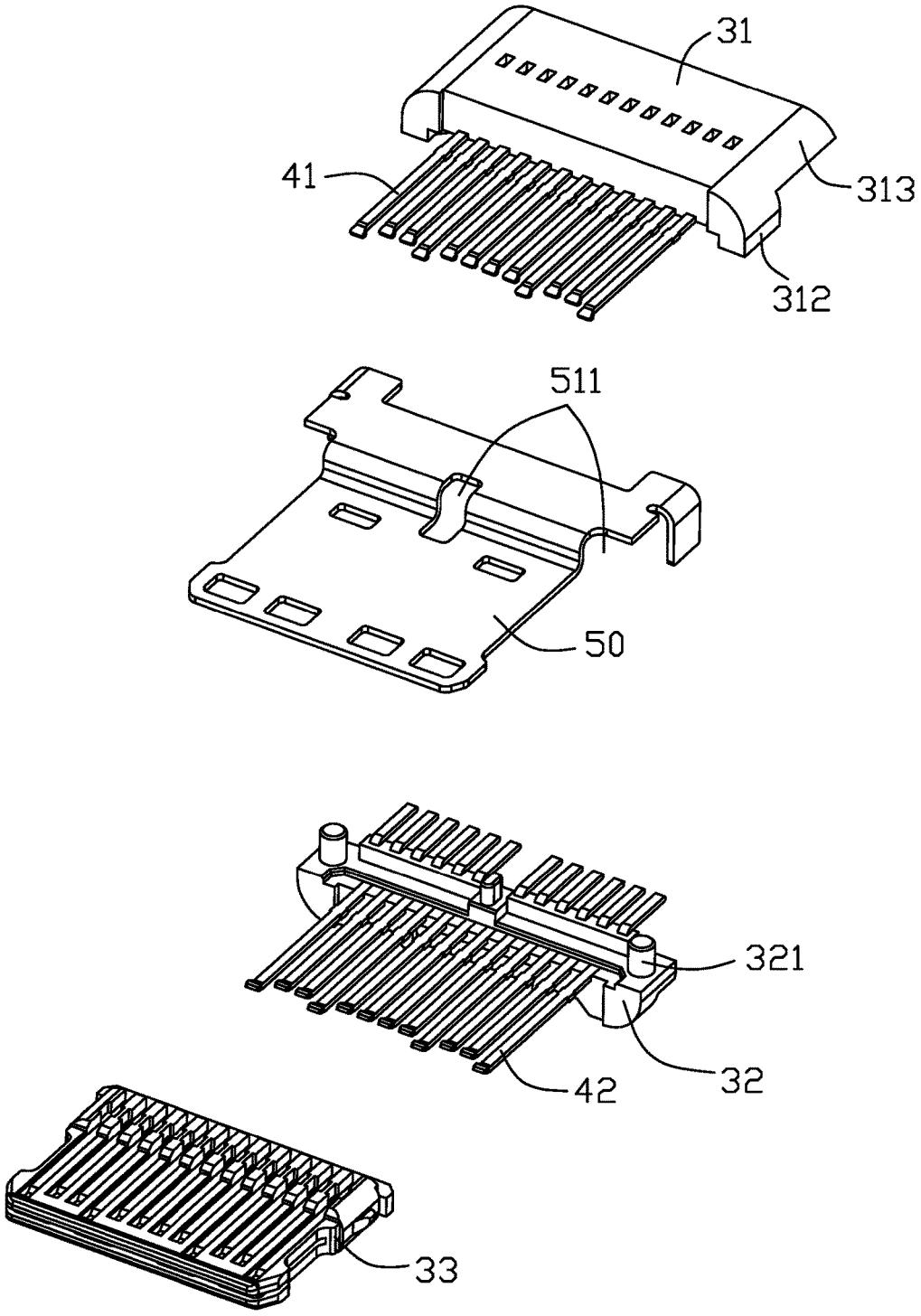
FIG. 5 is a further exploded perspective view of the contact module of the electrical connector of FIG. 1.
Figure 6:
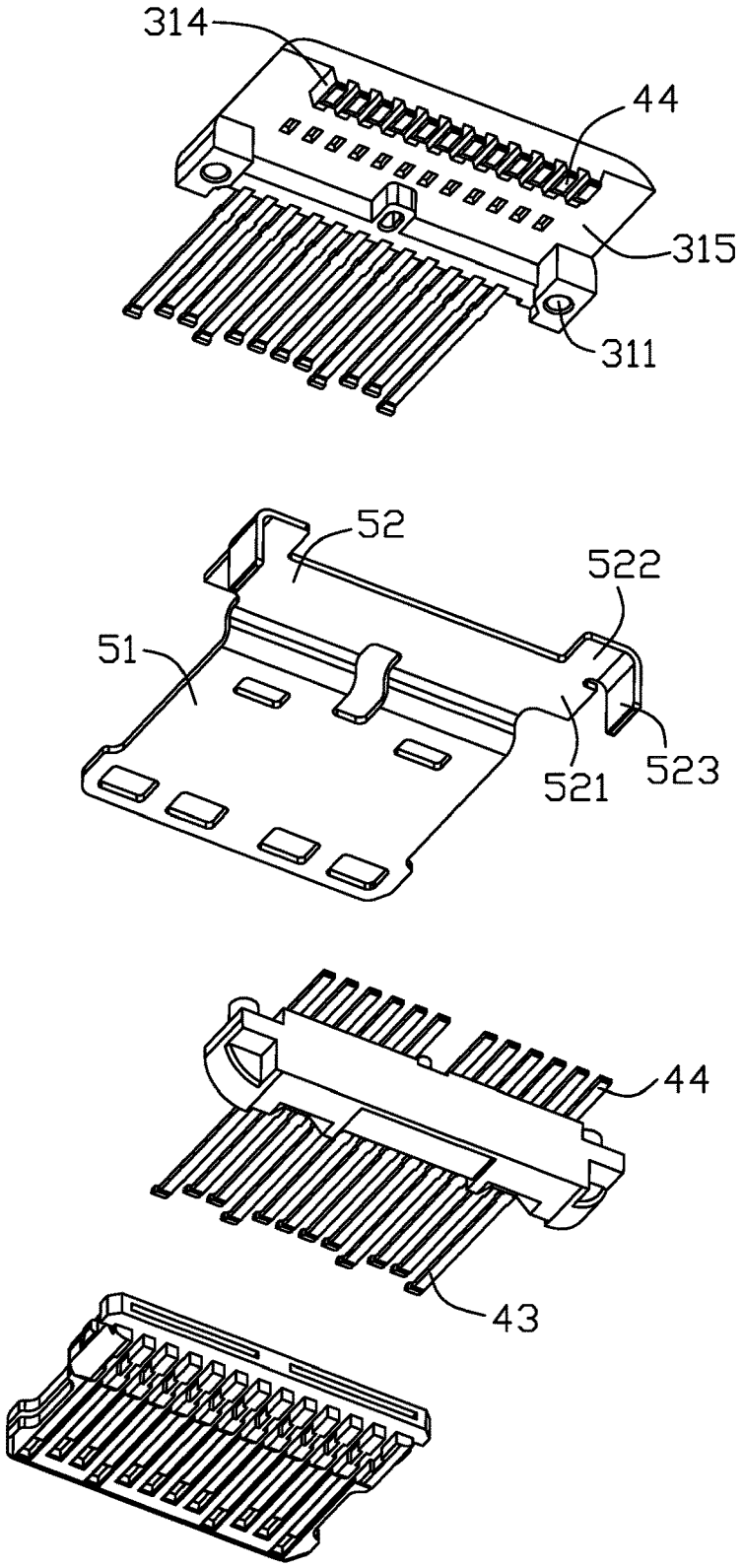
FIG. 6 is another exploded perspective view of the contact module of the electrical connector of FIG. 5.
Figure 7:
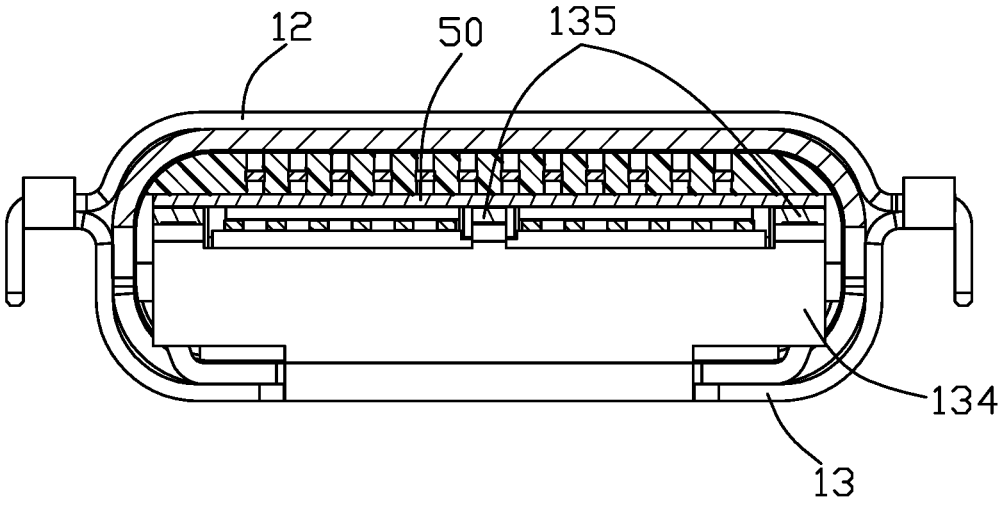
FIG. 7 is a cross-sectional view of the electrical connector of FIG. 1.

Reference will now be made in detail to the embodiments of the present disclosure. Referring to FIGS. 1-10, an electrical connector 100 is mounted to a printed circuit board (not shown) wherein the connector 100 includes a contact module 20 and a metallic shielding shell 10 enclosing the contact module. The contact module 20 includes a base 21 and a mating tongue 22 extending forwardly from the base 21. The mating tongue 22 includes a step structure around the root thereof, and a metallic collar 60 encloses the step structure for grounding with the complementary plug. The collar 60 includes an abutment section 61 secured to the base 21 and connects to the shell 10.

The metallic shell 10 includes an inner shell 11, an upper outer shell 12 and a lower outer shell 13 located by two opposite sides of the inner shell 11 in the vertical direction. The inner shell 11 is secured to the base 21 and surrounds the mating tongue 22 to form a mating cavity 101 therebetween. The inner shell 11 includes an upper wall 111, a lower wall 112, left and right side walls 113, 114 to connect the upper wall 111 and the lower wall 112. The upper wall 111 is longer than the lower wall 112 in the front-to-back direction. The upper wall 111 covers the base 21 and has a pair of fixing legs 115 on two sides and a plurality soldering legs 116 between the fixing legs 115 in the transverse direction. The upper outer shell 12 includes a top wall 121 covering the upper wall 111, and a pair of first side walls 122 extending downwardly from two sides the top wall 121. The first side wall 122 has first securing sections 123 and mounting legs 124 beside the first securing sections 123. The lower outer shell 13 includes a bottom wall 131 covering the lower wall 112, and a pair of second side wall 132 extending upwardly from two sides of the bottom wall 131, and a rear wall 134 extending upwardly from a rear edge of the bottom wall 131. The second side wall 132 further extends with a second securing sections 133. The first securing sections 123 and the second securing section 133 are secured together to firmly sandwich the inner shell 11 therebetween. The top wall 121 of the upper outer shell 12 and the upper wall 111 of the inner shell 11, and the bottom wall 131 of the lower outer shell 13 and the bottom wall 112 of the inner shell 11 can be soldered together for securing therebetween. The rear wall 134 of the lower outer shell 13 has three contacting legs 135.

The contact module 20 includes an insulative housing 30 and a plurality of upper contacts 41, a plurality of lower contacts 42 and a metallic shielding plate 50 therebetween all commonly retained in the insulative housing 30. Each of the upper contacts 41 and the lower contacts 42 has a front contacting section 43 exposed upon the mating tongue 22, and a rear connecting section 44 exposed outside of the housing 30. The housing 30 includes the upper insulator 31 integrally formed with the upper contacts 41 via an insert-molding process, a lower insulator 32 integrally formed with the lower contacts 42 via another insert-molding process, and a front insulator 33 to integrally formed with the contacting sections 43 of both the upper contacts 41 and the lower contacts 42 via another insert-molding or over-molding process. The upper insulator 31 has a plurality of positioning holes 311, the lower insulator 32 has a plurality of positioning posts 321, the shielding plate 50 has a plurality of notches 511 so as to allow the positioning posts 321 to extend through the corresponding openings 511 into the corresponding positioning holes 311. The upper insulator 31 and the lower insulator 32 commonly form the base 21. The contacting sections 43 of upper contacts 41 are exposed in front of the upper insulator 31, and the contacting sections of the lower contacts 43 of the lower contacts 42 are exposed in front of the lower insulator 32. The front insulator 33 are insert-molded upon the contact sections 43 of the upper contacts 41 and those of the lower contacts 42 for forming the mating tongue 22. The mating tongue 22 includes opposite mating surfaces 221 on which the contacting sections 43 of the upper contacts 41 and the lower contacts 42 are exposed to an exterior. The upper insulator 31 includes a positioning section 312 for securing to the lower insulator 32, and a mounting section 313 behind the positioning section 312. The mounting section 313 forms a protruding blocks 314 on which the connecting sections 44 of the upper contacts 41 are supported. The connecting sections 44 of the upper contacts 41 and those of the lower contacts 42 are located at a same horizontal plane which is also the mounting surface of the connector 100. A receiving space 315 is formed between the protruding block 314 and the positioning section 312 for receiving the shielding plate 50.

The shielding plate 50 is sandwiched between the upper insulator 31 and the lower insulator 32 and includes a first/front part 51 in the mating tongue 22, and a second/rear part 52 in the base 21. The first part 51 and the second part 52 has therebetween an offset transition section in which the openings 511 are formed for receiving the positioning posts 321. The second part 52 includes a supporting section 521, a pair of extension section 522 and a pair of legs 523 extending downwardly from the extension section 522.

The upper insulator 31, the lower insulator 32 and the front insulator 33 commonly form the insulative housing 30. The first part 51 of the shielding plate 50 is embedded within the mating tongue 22, and the second part 52 of the shielding plate 50 is received within the receiving space 315 wherein the supporting section 521 is seated upon the mounting surface of the connector. The three contacting legs 135 of the rear wall 134 of the lower outer shell 13 are soldered upon the supporting sections 521. A space is formed between the pair of extension sections 521 to receive the protruding block 314 therein so as to allow the connecting sections 44 of the upper contacts 41 can be lowered to be coplanar with the contacting sections 44 of the lower contacts 42. The second part 52 of the shielding plate 50 is located above and spaced from the contacting sections of the lower contacts 42 in the vertical direction for avoiding the shorting risk. The legs 523 abut against the fixing legs 115 in the transverse direction. A rear edge of the lower wall 112 of the inner shell 11 forms a securing section 117 to be received within the recess 322 in the lower insulator 32 for preventing backward movement of the contact module 20 from the inner shell 11.

The invention includes several features as follows. The upper outer shell 12 and the lower outer shell 13 commonly sandwiching the inner shell 11, and the outer lower shell forms contacting legs 135 soldered to the shielding plate 50. The legs 523 of the shielding plate 50 intimately abut against the corresponding fixing legs 115 of the inner shell 11, respectively, in the transverse direction wherein both the legs 523 and the fixing legs 115 are essentially located at a rear end of the connector 100. The shielding plate 50 forms a space between the pair of side extension sections 522 to allow contacting sections 44 of the upper contacts 41 with the associated upper insulator 31 to downwardly extend therethrough to be coplanar with the contacting section 44 of the lower contacts 42. The mounting legs 124 formed around the first securing sections 123 of the upper outer shell 12 are located beside the mating cavity 101 in the transverse direction.

While a preferred embodiment according to the present disclosure has been shown and described, equivalent modifications and changes known to persons skilled in the art according to the spirit of the present disclosure are considered within the scope of the present disclosure as described in the appended claims.

What is claimed is:

1. An electrical connector comprising: a contact module including an insulative housing and a plurality of upper contacts and a plurality of lower contacts with a metallic shielding plate therebetween commonly integrally formed with the housing; a metallic inner shell receiving the contact module and defining a mating cavity therein; and a metallic outer shell positioned upon an exterior surface of the inner shell; wherein the outer shell includes a plurality of contacting legs mechanically and electrically connected to the shielding plate; wherein each of the upper contacts has a rear connecting section, and each of the lower contacts has a rear connecting section, and the rear connecting sections of the upper contacts and those of the lower contacts are located at a same level, and the contacting legs are located at another level higher than said level; wherein the shielding plate has a pair of extension sections with a space therebetween in a transverse direction at a rear region, so as to allow the connecting sections of the upper contacts to extend therethrough in a vertical direction for reaching the same level with the connecting sections of the lower contacts; wherein the shielding plate further includes a pair of legs extending downwardly from the pair of corresponding extension sections, respectively, and the inner shell further includes a pair of fixing legs intimately abutting against the pair of legs in a transverse direction.

2. The electrical connector as claimed in claim 1, wherein the contacting legs are located on two sides of and next to the connecting sections of the lower contacts in a transverse direction.

3. The electrical connector as claimed in claim 1, wherein the housing includes an upper insulator on which the upper contacts are integrally formed, and the upper insulator includes a protruding block downwardly extending through the space with the associated connecting sections of the upper contacts, and the connecting sections of the upper contacts upwardly abuts against the protruding block.

4. The electrical connector as claimed in claim 3, wherein said outer shell further includes an upper outer shell secured to the lower outer shell with the inner shell firmly sandwiched therebeteween.

5. The electrical connector as claimed in claim 4, wherein said upper shell further includes a pair of mounting legs located beside the mating cavity in a transverse direction.

6. The electrical connector as claimed in claim 1, wherein the outer shell includes a lower outer shell defining a rear wall, and the connecting sections extend unitarily from an upper edge of the rear wall.

7. The electrical connector as claimed in claim 1, wherein the contacting legs are soldered to the shielding plate.

8. An electrical connector comprising: a contact module including an insulative housing and a plurality of upper contacts, a plurality of lower contacts with a metallic shielding plate therebetween commonly integrally formed with the housing; a metallic inner shell enclosing the contact module to define a mating cavity therein; a lower outer shell attached to a lower portion of the inner shell and including a rear wall covering a rear side of a lower portion of the contact module, and a plurality of contacting legs extending from the rear wall; wherein said contacting legs extend in a horizontal plane and mechanically and electrically connected to the shielding plate in a vertical direction; wherein each of said upper contacts and said lower contacts has a rear horizontally extending connecting section, and all the connecting sections of both the upper contacts and the lower contacts are located at a same level which is lower than the horizontal plane; wherein the shielding plate has a pair of extension sections with a space therebetween in a transverse direction at a rear region, so as to allow the connecting sections of the upper contacts to extend therethrough in a vertical direction for reaching the same level with the connecting sections of the lower contacts; wherein the shielding plate further includes a pair of legs extending downwardly from the pair of corresponding extension sections, respectively, and the inner shell further includes a pair of fixing legs intimately abutting against the pair of legs in a transverse direction.

9. The electrical connector as claimed in claim 8, wherein the contacting legs are located on two sides of and next to the connecting sections of the lower contacts in a transverse direction.

10. The electrical connector as claimed in claim 8, wherein the housing includes an upper insulator on which the upper contacts are integrally formed, and the upper insulator includes a protruding block downwardly extending through the space with the associated connecting sections of the upper contacts, and the connecting sections of the upper contacts upwardly abuts against the protruding block.

11. The electrical connector as claimed in claim 8, wherein said outer shell further includes an upper outer shell secured to the lower outer shell with the inner shell firmly sandwiched therebeteween.

12. The electrical connector as claimed in claim 11, wherein said upper shell further includes a pair of mounting legs located beside the mating cavity in a transverse direction.

13. An electrical connector comprising: a contact module including an insulative housing and a plurality of upper contacts, a plurality of lower contacts with a metallic shielding plate therebetween commonly integrally formed with the housing, each of both the upper contacts and the lower contacts has a front contacting section and rear connecting section; a metallic inner shell enclosing the contact module to define a mating cavity therein; and an outer shell attached to the inner shell and including a pair of mounting legs by two sides of the mating cavity in a transverse direction; wherein the metallic shielding plate extends rearwardly to reach a rear end of the housing and defining a pair of extension sections on two sides with a receiving space therebetween in the transverse direction to allow the upper contacts with an associated protruding block of the housing to downwardly extend so as to have the connecting sections of the upper contacts and those of the lower contacts located at a same horizontal plane below another plane defined by a horizontal rear part of the shielding plate where the receiving space is formed; wherein the shielding plate further includes a pair of legs extending downwardly from the pair of corresponding extension sections, respectively, and the inner shell further includes a pair of fixing legs intimately abutting against the pair of legs in a transverse direction.

14. The electrical connector as claimed in claim 13, wherein the outer shell further includes a plurality of contacting legs mechanically and electrically connected to the horizontal rear part of the shielding plate upwardly.

* * * * *